US008356391B2

(12) United States Patent
Iwase

(10) Patent No.: US 8,356,391 B2
(45) Date of Patent: Jan. 22, 2013

(54) SLIDER FOR SLIDE FASTENER WITH AUTOMATIC STOPPER

(75) Inventor: Yuichi Iwase, Toyama (JP)

(73) Assignee: YKK Corporation (JP)

( * ) Notice: Subject to any disclaimer, the term of this patent is extended or adjusted under 35 U.S.C. 154(b) by 181 days.

(21) Appl. No.: 12/990,325

(22) PCT Filed: May 1, 2008

(86) PCT No.: PCT/JP2008/058347

§ 371 (c)(1),
(2), (4) Date: Oct. 29, 2010

(87) PCT Pub. No.: WO2009/133617

PCT Pub. Date: Nov. 5, 2009

(65) Prior Publication Data

US 2011/0041297 A1 Feb. 24, 2011

(51) Int. Cl.
*A44B 19/30* (2006.01)

(52) U.S. Cl. ..... 24/421; 24/429

(58) Field of Classification Search ..... 24/429, 24/430, 419–425

See application file for complete search history.

(56) References Cited

U.S. PATENT DOCUMENTS

| | | | | |
|---|---|---|---|---|
| 5,848,455 | A | 12/1998 | Ikehara et al. | |
| 6,654,988 | B1 | 12/2003 | Chung | |
| 2004/0231114 | A1 | 11/2004 | Iwase et al. | |
| 2004/0231115 | A1 * | 11/2004 | Keyaki et al. | 24/429 |

FOREIGN PATENT DOCUMENTS

| | | | |
|---|---|---|---|
| JP | 58-100611 | A | 7/1983 |
| JP | 10-127313 | A | 5/1998 |
| JP | 2004-344313 | A | 12/2004 |

OTHER PUBLICATIONS

International Search Report, PCT Application No. PCT/JP08/058347, mailed Jul. 22, 2006.

Supplementary European Search Report, European Patent Application No. 0875227.7, mailed Mar. 28, 2012.

* cited by examiner

*Primary Examiner* — James Brittain

(74) *Attorney, Agent, or Firm* — Kilpatrick Townsend & Stockton LLP

(57) ABSTRACT

There are provided interlock pieces extending from both edge portions of a side-to-side winglike piece provided in a pull-tab retainer toward an anterior wall part and a posterior wall part of the pull-tab retainer. An anterior support wall of an anterior mounting post and a posterior support wall of a posterior mounting post at superior angular corner regions of the internal faces thereof are provided with notches for interlocking of the interlock pieces. When the pull-tab retainer is fitted to the anterior mounting post and the posterior mounting post, the interlock pieces and the notches are interlocked with together to thereby prevent any displacement of the pull-tab retainer in anteroposterior side-to-side directions. Further, at that time, a side end face of the anterior support wall and a side end face of the posterior support wall can be covered up by the pull-tab retainer.

4 Claims, 9 Drawing Sheets

SLIDER FOR SLIDE FASTENER WITH AUTOMATIC STOPPER

This application is a national stage application of PCT/JP2008/058347, which is incorporated herein by reference.

TECHNICAL FIELD

The present invention relates to a slider for a slide fastener with an automatic stopper that is mounted with a spring body for the slide fastener. Particularly, the present invention relates to a slider with an automatic stopper in which displacement of a pull-tab retainer for holding a spring body in antero-posterior side-to-side directions is prevented, which can be realized in a compact size and manufactured at lower cost, and which has a greatly improved exterior design.

BACKGROUND ART

Conventionally, a slider that includes an automatic stopper is used in many cases as a slider for a slide fastener. In the slider that includes the automatic stopper, if a pull tab that slides a slider body to couple and release tooth rows of a fastener chain is operated with respect to the slider body, the movement of the slider body can be stopped and a movement stop state of the slider body can be released.

By operating the pull tab, a claw part of the spring body made of a long and minute elastic metal plate member can be engaged with a part of the tooth rows of the fastener chain by the biasing force of the spring body and the movement of the slider can be stopped. If the biasing force of the spring body with respect to the claw part is released by operating the pull tab, the movement stop state of the slider can be released.

As an example of a structure of the slider with the automatic stopper of the above type, a slider for a slide fastener with an automatic stopper (refer to Patent Document 1) that is previously suggested by the present applicant is known.

In the slider disclosed in Patent Document 1, a claw part of a spring body can be engaged with a part of tooth rows of a fastener chain by the biasing force of a spring piece provided in the spring body. In addition, a state where the claw part is engaged with the part of the tooth rows of the fastener chain is maintained by the biasing force of the spring piece, as long as the spring body is not lifted against the biasing force of the spring piece.

If the pull tab is lifted forward or pulls the pull tab backward with a hand, the spring body can be lifted against the biasing force from the spring piece, and the claw part of the spring body can be separated from the tooth rows of the fastener chain. Therefore, the slider can be freely slid.

If the pull tab lifted forward or pulled backward is released, the claw part is automatically inserted again between the tooth rows of the fastener chain by the biasing force from the spring piece, and the slider can be stopped.

Meanwhile, the spring body disclosed in Patent Document 1 is made of a metallic material such as a copper alloy having strong spring stiffness or stainless steel. A segment is partially cut from a long plate member having a predetermined sectional shape such that a part of the segment remains, and the spring body that includes the spring piece can be manufactured. However, since the spring body is configured as a small piece with the magnitude of about several millimeters, the width and the length of the spring body that is blanked along an outer end edge of the molding material further decrease.

For this reason, in the slider according to the related art disclosed in Patent Document 1, various problems to be described below are generated. For example, when the spring body is formed of the above-described metallic material having high toughness, blanking working or bending working is performed with respect to a very small component such as the spring piece. For this reason, cracking may be generated with respect to the metallic material or a blade of a blanking punch may be worn early during the blanking working or the bending working.

That is, if the excessive force is applied to a fore-end of the spring piece, the spring piece breaks or cracks.

For this reason, it is difficult to improve working precision with respect to the fore-end of the spring piece and thereby to expect form stability, and there is a limit to achieve mass production of spring body products with high precision.

In order to resolve the conventional problems, the present applicant has improved the configuration of a spring body for a slide fastener as a slider, and as a result, suggested a slide fastener mounted with a spring body for a slider disclosed in Patent Document 2. In the slider that is disclosed in Patent Document 2, a material cost or a manufacturing cost that is needed to manufacture the spring body can be reduced, and stable and excellent productivity can be achieved when the spring body is manufactured. Further, the slider has a simple structure and a superior exterior design, which is achieved at low cost, and the slider ensures a stable excellent automatic stop function and is realized in a compact size.

FIG. 9 shows a perspective view of the slider disclosed in Patent Document 2 as a conventional example of the present invention. As shown in FIG. 9, a pull-tab retainer 51 is made of a long thin plate member. In anterior and posterior portions of a flat upper wall part 52, anterior and posterior wall parts 53 and 54 are formed to be smoothly curved with the same curvature, respectively. The pull-tab retainer 51 is configured as a cover body that has a substantially lateral C-shape in side view.

In anterior and posterior portions of a top surface of a slider body 60, an anterior mounting post 61 and a posterior mounting post 62 stand, respectively. In interlocked parts (not shown in the drawings) that are formed in the anterior and posterior mounting posts 61 and 62, engagement pieces (not shown in the drawings) that are formed in internal faces of fore-ends of the anterior and posterior wall parts 53 and 54 in the upper wall part 52 can be elastically engaged. Further, side-to-side winglike pieces 55 and 55 having the large width that covers and shields a part of a space between the anterior mounting post 61 and the posterior mounting post 62 are curved from the upper wall part 52 and protrude downward. In the anterior and posterior mounting posts 61 and 62, a pair of left and right support walls 61*a* and 62*a* is provided, respectively. The above description relates to the schematic structure of the slider 50 that is disclosed in Patent Document 2.

Meanwhile, in the configuration of the slider 50 described in Patent Document 2, the exterior shape based on the pull-tab retainer 51 and the configuration that prevents the pull-tab retainer 51 from moving in the side-to-side direction by an action of the external force are technologically associated with the present invention.

Thus, the internal structure of the slider 50 that is described in Patent Document 2 will not be described, and the exterior shape based on the pull-tab retainer 51 and the configuration that prevents the pull-tab retainer 51 from moving in the anteroposterior side-to-side directions by the external force will be described.

As shown in FIG. 9, if engagement pieces (not shown in the drawings) of the pull-tab retainer 51 are elastically engaged with interlocked parts (not shown in the drawings) of the anterior and posterior mounting posts 61 and 62, the pull-tab retainer 51 is engaged with the anterior and posterior mounting posts 61 and 62 and is mounted on the slider body. The pull-tab retainer 51 can be fitted between opposing faces of the anterior and posterior mounting posts 61 and 62 and can be supported. The upper wall part 52 and the anterior and posterior wall parts 53 and 54 of the pull-tab retainer 51 and the support walls 61*a* and 62*a* can be disposed such that the top surfaces thereof are flush with each other.

By this configuration, the pull-tab retainer 51 can be configured to have the minimum thickness, and the slider 50 can be configured to be compact and thin. The slider 50 that has an excellent exterior design and a high commodity value can be obtained.

In the anterior mounting post 61 and the posterior mounting post 62 that stand in the anterior and posterior portions of the top surface of the slider body 60, a pair of protrusions 61*b* and 62*b* that face toward the inner side are formed, respectively. In a ridge line part (angular part) between the pair of side-to-side winglike pieces 55 and the upper wall part 52 provided in the pull-tab retainer 51, missing parts 56*a* and 56*b* are formed. The missing parts 56*a* and 56*b* are configured as stepped parts that are recessed inward from both linear side end faces in the side-to-side winglike piece 55 to the inner side.

If the pair of protrusions 61*b* and 62*b* are fitted and fasten with the missing parts 56*a* and 56*b*, respectively, the pull-tab retainer 51 can be prevented from moving in the anteroposterior side-to-side directions due to the action of the external force.

By the above-described structure of the slider 50, the pull-tab retainer 51 does not swing against the external force in the anteroposterior side-to-side directions, and the pull-tab retainer 51 can be firmly and surely mounted in the anterior and posterior mounting posts 61 and 62. A spring piece of the spring body (not shown in the drawings) disposed between the pull-tab retainer 51 and the slider body 60 can be smoothly and surely held. Accordingly, a quality of the slider 50 for the slide fastener with the automatic stopper can be stably ensured over a long period.

Patent Document 1: Japanese Patent Application Laid-Open No. 10-127313

Patent Document 2: Japanese Patent Application Laid-Open No. 2004-344313

DISCLOSURE OF THE INVENTION

Problems to be Solved by the Invention

The slider 50 described in Patent Document 2 is configured to have an excellent exterior design. In the slider 50, the pull-tab retainer 51 is configured to be disposed between the support walls 61*a* and 62*a* of the anterior and posterior mounting posts 61 and 62, the missing parts 56*a* and 56*b* and the protrusions 61*b* and 62*b* are fasten, and the pull-tab retainer 51 is prevented from moving in the anteroposterior side-to-side directions due to the action of the external force.

For this reason, as for the exterior shape of the slider 50, the side end faces of the support walls 61*a* and 62*a* are visible from the outside of the slider 50, and a fastening state of the missing parts 56*a* and 56*b* and the protrusions 61*b* and 62*b* are visible from the outside of the slider 50.

Then, by obtaining the configuration where the side end faces of the support walls 61*a* and 62*a* and the fastening state of the missing parts 56*a* and 56*b* and the protrusions 61*b* and 62*b* are invisible from the outside a slider for a slide fastener with an automatic stopper can be configured in a simpler external shape and the slider can be configured to have a more excellent exterior design. By this configuration, value of the slider fastener product using the slider for the slide fastener with the automatic stopper can be significantly increased.

Accordingly, the present invention provides a slider for a slide fastener with an automatic stopper that achieves the functions of the slider for the slide fastener with the automatic stopper disclosed in Patent Document 2, and has a good exterior design by removing the configuration of the missing parts formed in the pull-tab retainer and rendering the side end faces of the support walls 61*a* and 62*a* invisible from the outside.

Means for Solving the Problems

In order to achieve the above object, a slider for a slide fastener with an automatic stopper according to the present invention includes: a slider body that couples and releases tooth rows of a fastener chain; a pull tab that slides the slider body; a pull-tab retainer that is mounted and supported on the slider body and movably holds the pull tab between a top surface of the slider body and the pull-tab retainer; and a spring body that is disposed between a back surface of the pull-tab retainer and the slider body, the spring body has a spring piece that is disposed between the back surface of the pull-tab retainer and the pull tab to elastically contact the back surface of the pull-tab retainer, and a claw part that is engaged with or is disengaged from a part of the tooth rows of the fastener chain passing through the slider body, on the basis of elastic deformation of the spring piece based on an operation of the pull tab, in anterior and posterior portions of the top surface of the slider body, an anterior mounting post and a posterior mounting post where engaged parts are formed are provided, respectively, the pull-tab retainer is configured as a cover body with a substantially lateral C shape in side view that has anterior and posterior wall parts formed in anterior and posterior portions of a flat upper wall part, in internal faces of each of fore-ends of the anterior and posterior wall parts, engagement pieces that are elastically engaged with the engaged parts are formed, being characterized in that in a side-to-side direction of the slider, a width dimension of the pull-tab retainer and width dimensions of the anterior mounting post and the posterior mounting post are configured to be almost equal to each other, regulating mechanisms that regulate movement of the upper wall part of the pull-tab retainer in the side-to-side direction are provided between the pull-tab retainer and at least one of the anterior mounting post and the posterior mounting post, the regulating mechanisms include interlock parts that are provided in the pull-tab retainer and interlocked parts that are provided in at least the anterior mounting post or the posterior mounting post and interlock the interlock parts of the pull-tab retainer, and when engagement pieces of the pull-tab retainer are engaged with an engaged part of the anterior mounting post and an engaged part of the posterior mounting post, respectively, the interlock parts and the interlocked parts are interlocked with each other, and the pull-tab retainer is disposed to cover up side end faces of the anterior mounting post and the posterior mounting post.

Also, in the slider for a slide fastener with an automatic stopper according to the present invention, the pull-tab retainer has a side-to-side winglike piece that protrudes downward from both sides of the upper wall part of the pull-tab retainer and covers and shields a space between the anterior mounting post and the posterior mounting post, the anterior mounting post and the posterior mounting post have support walls that are erect on left and right end faces of the anterior mounting post and the posterior mounting post, respectively, the interlock parts are configured in a shape protruding downward from a back surface of the upper wall part, between a side end face of the side-to-side winglike piece and back surface sides of the anterior and posterior wall parts, at the side of the internal face of the side-to-side winglike piece in the side-to-side direction of the slider, and the interlocked parts are formed in a shape storing the interlock parts, at the side of internal faces of the support walls in the side-to-side direction of the slider.

In the slider for a slide fastener with an automatic stopper according to the present invention, the interlock parts are configured in a shape extending toward the anterior and posterior wall parts from the side-to-side winglike piece, and the interlocked part is configured as a stepped part where the upper portion and the side portions are open, in superior angular corner regions where the anterior support wall and the posterior support wall stand to face each other in the internal faces of the support walls.

In the slider for a slide fastener with an automatic stopper according to the present invention, the interlock parts have first interlock parts that are configured in a shape extending toward the anterior and posterior wall parts from the side-to-side winglike piece and second interlock parts that are fitted between the internal faces of the support walls, when the engagement pieces of the pull-tab retainer are engaged with the engaged part of the anterior mounting post and the engaged part of the posterior mounting post, respectively. The interlocked parts engage the first interlock parts, and have stepped parts where the upper portion and the side portions are open, in superior angular corner regions where the anterior support wall and the posterior support wall stand face to face with each other in the internal faces of the support walls and parts of an outer edge side in the internal faces of the support walls.

Also, in the slider for a slide fastener with an automatic stopper according to the present invention, in the protrusion amount from the back surface of the upper wall part, the protrusion amounts in the first interlock parts are larger than the protrusion amounts in the second interlock parts.

Effects of the Invention

In the configuration of the present invention, the function of the slider for the slide fastener with the automatic stopper disclosed in Patent Document 2 can be achieved. In the present invention, in the side-to-side direction of the slider, the width dimension of the pull-tab retainer and the width dimensions of the anterior mounting post and the posterior mounting post are configured to be almost equal to each other. The regulating mechanism that regulates movement of the pull-tab retainer in the anteroposterior side-to-side directions is configured by the interlock parts provided in the pull-tab retainer and the interlocked parts to be provided in at least the anterior mounting post or the posterior mounting post and interlock the interlock parts of the pull-tab retainer.

The width dimension of the pull-tab retainer and the width dimensions of the anterior mounting post and the posterior mounting post are configured to be almost equal to each other, and the regulating mechanism is provided. As a result, the configuration of the missing parts formed in the pull-tab retainer and the pair of protrusions facing toward the inner side from the anterior mounting post and the posterior mounting post that are included in the slider for the slide fastener with the automatic stopper disclosed in Patent Document 2 can be removed.

The pull-tab retainer that is configured to have the width dimension almost equal to the width dimensions of the anterior mounting post and the posterior mounting post are engaged with the anterior mounting post and the posterior mounting post and are mounted on the slider body, and thus, the side end faces of the anterior mounting post and the posterior mounting post can be covered up by the pull-tab retainer. Accordingly, each of the side end faces of the anterior mounting post and the posterior mounting post can be configured to be invisible from the outside.

When the pull-tab retainer is mounted in the anterior mounting post and the posterior mounting post, the side of the pull-tab retainer and the external sides of the anterior mounting post and the posterior mounting post can be disposed to be substantially flush with each other. Accordingly, as the exterior shape of the slider according to the present invention, a simple shape can be configured such that the anterior mounting post and the posterior mounting post exist in the lower part of the back surface side of the pull-tab retainer. The slider where the unevenness shape is not viewed from the outside and an exterior design is excellent can be configured.

Since the pull-tab retainer and the anterior mounting post and the posterior mounting post are configured with the simple structure, respectively, a manufacturing cost of the slider can be reduced and the slider can be manufactured at a low cost. The downsizing and miniaturization of the slider can be achieved while the stable excellent automatic stop function can be ensured.

In the slider for the slide fastener with the automatic stopper according to the present invention, the side-to-side winglike piece that protrudes downward from the left and right side of the upper wall part and covers and shields the space between the anterior mounting post and the posterior mounting post is provided in the pull-tab retainer.

When the pull tab is lifted upward by providing the side-to-side winglike piece, a pivot of the pull tab comes into contact with the side-to-side winglike piece, and the movement amount when the pivot of the pull tab moves upward can be regulated by the side-to-side winglike piece. Accordingly, even if a spring piece is deformed, the excessive deformation is not generated in the spring piece. When the state of the spring piece is returned to the original state, a cutout hole part and the spring piece are not hooked, and the state of the spring piece can be smoothly and surely returned to the original state. The elastic deformation function in the spring piece can be ensured over a long period.

When the pull-tab retainer is engaged with the anterior mounting post and the posterior mounting post and is mounted on the slider body, the side-to-side winglike piece acts as the guide piece. For this reason, when the pull-tab retainer is mounted, the pull-tab retainer does not swing in the anteroposterior side-to-side directions, and the pull-tab retainer can be firmly and surely mounted in the anterior mounting post and the posterior mounting post. Accordingly, since the pivot of the pull tab and the spring body can be surely held between the slider body and the pull-tab retainer, the quality of the slider can be ensured over a long period.

As the configuration of the regulating mechanism in the present invention, the interlock parts that are provided in the pull-tab retainer can be configured in a shape protruding downward from the back surface of the upper wall part of the pull-tab retainer, between the side end face of the side-to-side winglike piece and the internal face sides of the anterior and posterior wall parts, at the internal face sides of the side-to-side winglike pieces in the side-to-side direction of the slider. The interlocked parts can be configured in a shape storing the interlock parts of the pull-tab retainer, at the internal face side of the support wall in the side-to-side direction of the slider.

By configuring the regulating mechanism in the above way, when the pull-tab retainer is engaged with the anterior mounting post and the posterior mounting post and is mounted on the slider body, the interlock parts can be interlocked with the interlocked parts at the same time as it is mounted. Since the interlock parts are interlocked with the interlocked parts formed on the internal face side of the support walls, interlocking parts of the interlock parts and the interlocked parts are not viewed from the outside.

Since the interlock parts and the interlocked parts can be interlocked with each other, the pull-tab retainer can be surely prevented from moving in the anteroposterior side-to-side directions by the action of the external force applied to the pull-tab retainer.

As the configuration of the interlock parts, the interlock parts can be configured in a shape that extends from the side-to-side winglike piece to the anterior and posterior wall parts. As the configuration of the interlocked parts, the interlocked parts can be configured as stepped parts where the upper portion and the side portions are open, in the angular corner regions of the internal face side of the support walls. As the configuration of the interlock parts, the interlock parts can be configured as convex parts that are fitted between the internal faces of the support walls and configure an interlock state between the internal faces of the support walls.

As the configuration of the interlock parts, the interlock parts can be configured as protruding pieces that are erect from the back surface of the pull-tab retainer. As the configuration of the interlocked parts, the interlocked parts can be configured on the side end faces of the support walls, as hole parts where the protruding pieces can be fitted. Alternatively, the configurations of the interlock parts and the interlocked parts may be arbitrarily combined to configure and the regulating mechanism.

As the configuration of the interlock parts, each of the interlock parts include first interlock parts and second interlock parts. As the configuration of the interlocked parts, when the interlocked parts include stepped parts where the first interlock parts are interlocked and parts of the outer edge side of the support walls between the internal faces of the support walls provided in the anterior and posterior mounting posts where the second interlock parts are fitted and interlocked, in regards to the protrusion amounts from the back surface of the upper wall part of the pull-tab retainer, the protrusion amounts of the first interlock parts can be configured to be larger than the protrusion amounts of the second interlock parts.

Since the protrusion amounts of the first interlock parts can be configured to be larger than the protrusion amounts of the second interlock parts, the protrusion amounts of the second interlock parts can be decreased. Accordingly, the flexibility in the pull-tab retainer can be enhanced. When the pull-tab retainer is engaged with the anterior and posterior mounting posts, the pull-tab retainer is elastically deformed and the gap between both edge portions of the pull-tab retainer is easily expanded. The pull-tab retainer can be prevented from being damaged during the elastic deformation to expand the gap between both edge portions, and the elastic force in the pull-tab retainer can be increased.

Even though the protrusion amounts of the second interlock parts are configured to be small or zero, the first interlock parts can be interlocked with the stepped parts formed in the support walls. Therefore, the pull-tab retainer can be surely prevented from being displaced in the anteroposterior side-to-side directions, even though the external force is applied to the pull-tab retainer in the anteroposterior side-to-side directions.

DESCRIPTION OF REFERENCE NUMERALS

Figure 1:
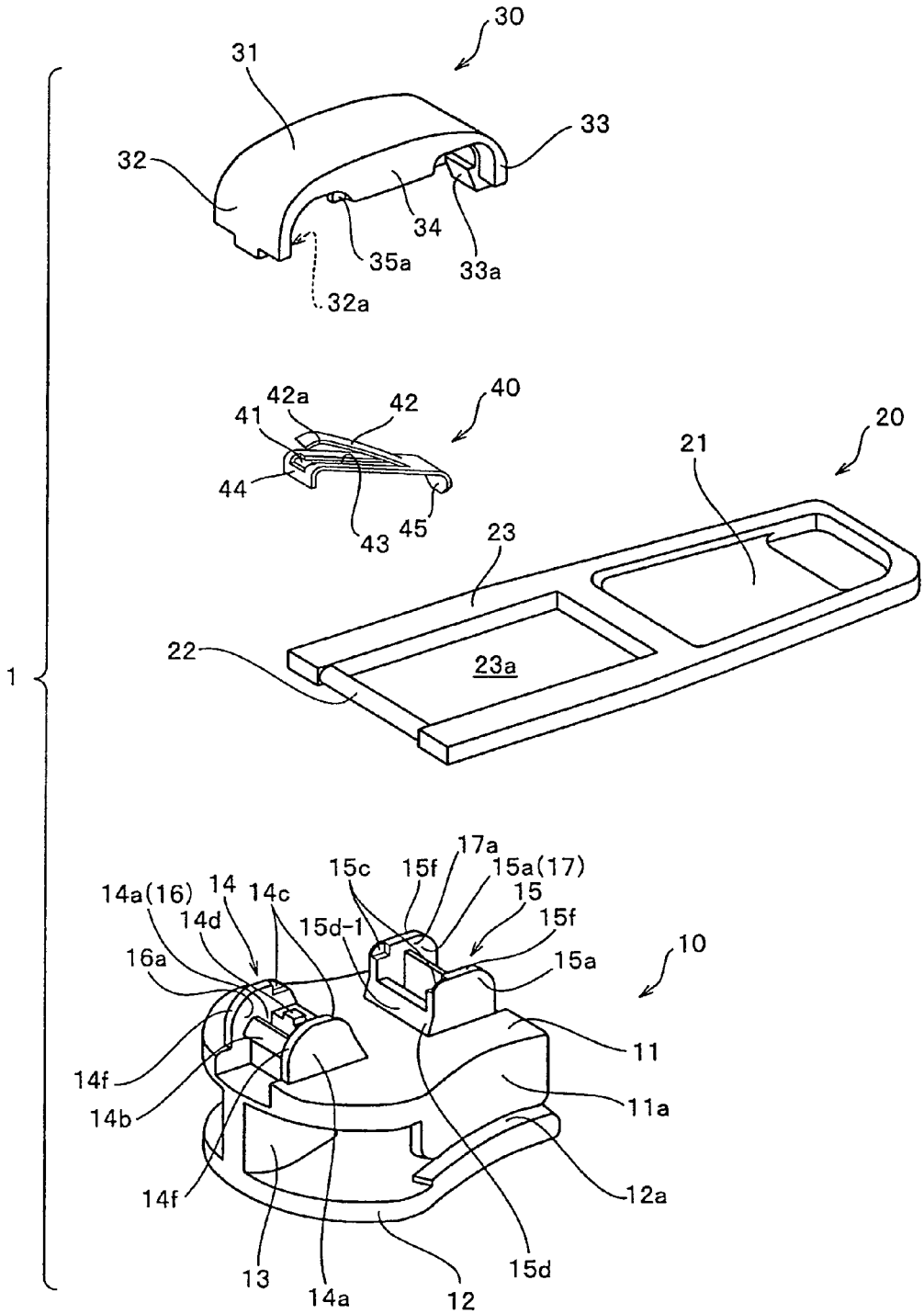
FIG. 1 is a perspective view showing a state before components constituting a slider for a slide fastener with an automatic stopper are assembled (a first embodiment).

1: slider
10: slide body
14: anterior mounting post
14*a*: anterior support wall
14*c*: notch
15: posterior mounting post
15*a*: posterior support wall
15*c*: notch
19: interlocked hole part
20: pull tab
22: pivot
30: pull-tab retainer
35*a*, 35*b*: first interlock part
37*a*, 37*b*: second interlock part
39: protrusion interlock piece
40: spring body
42: spring piece
45: claw part
50: slider
51: pull-tab retainer
55: winglike piece
56*a*, 56*b*: missing part
60: slider body
61: anterior mounting post
61*b*: protrusion
62: posterior mounting post
62*b*: protrusion

BEST MODES FOR CARRYING OUT THE INVENTION

Hereinafter; preferred embodiments of the present invention will be specifically described referring to the accompanying drawings.

Figure 2:
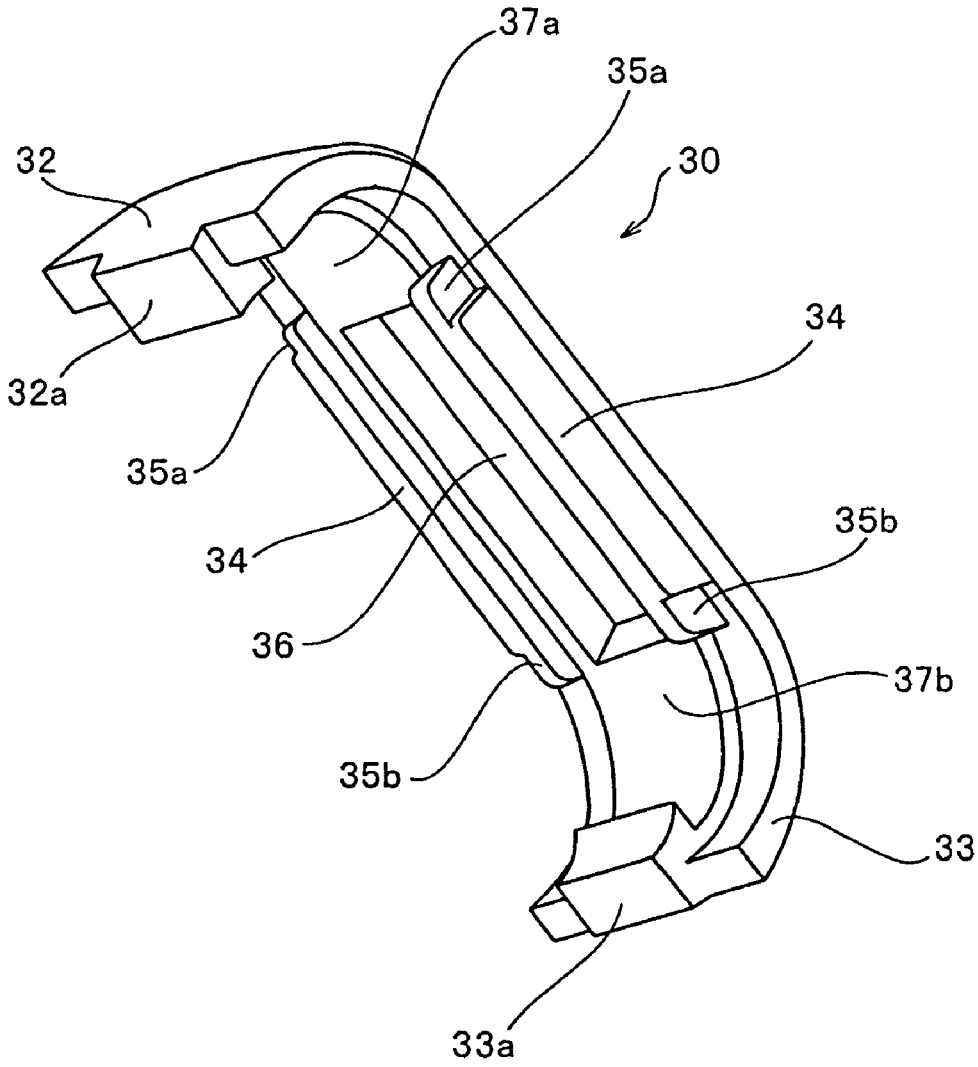
FIG. 2 is a perspective view of a pull-tab retainer when viewed from the side of a back surface (the first embodiment).
Figure 3:
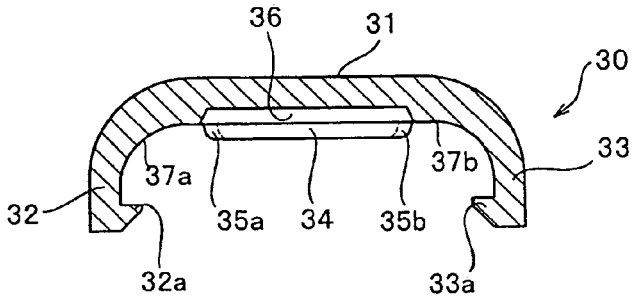
FIG. 3 is a main part longitudinal cross-sectional view showing an assembly sequence of the slider (the first embodiment).
Figure 3:
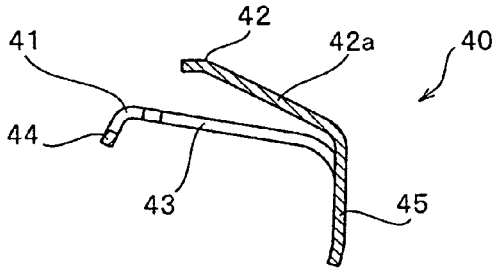
Figure 3:
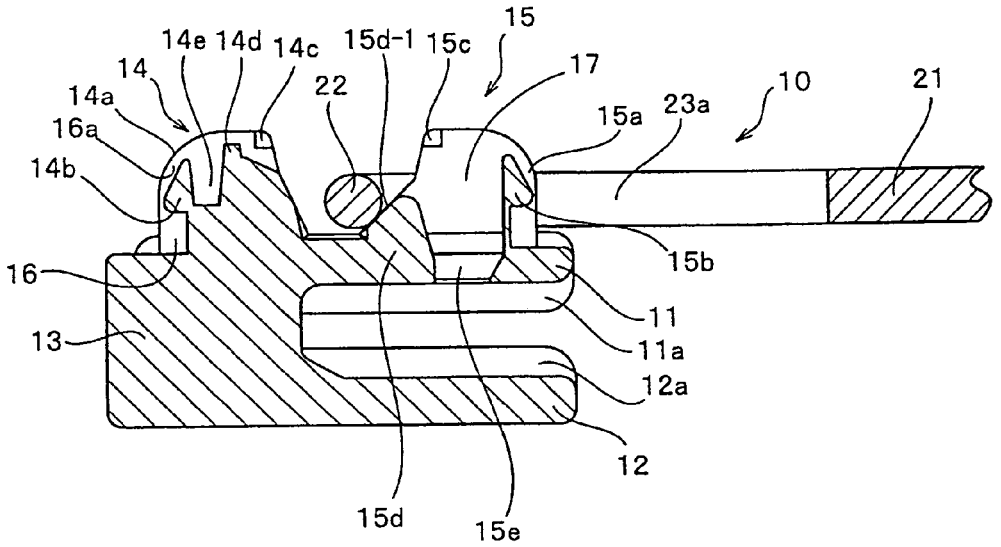
Figure 4:
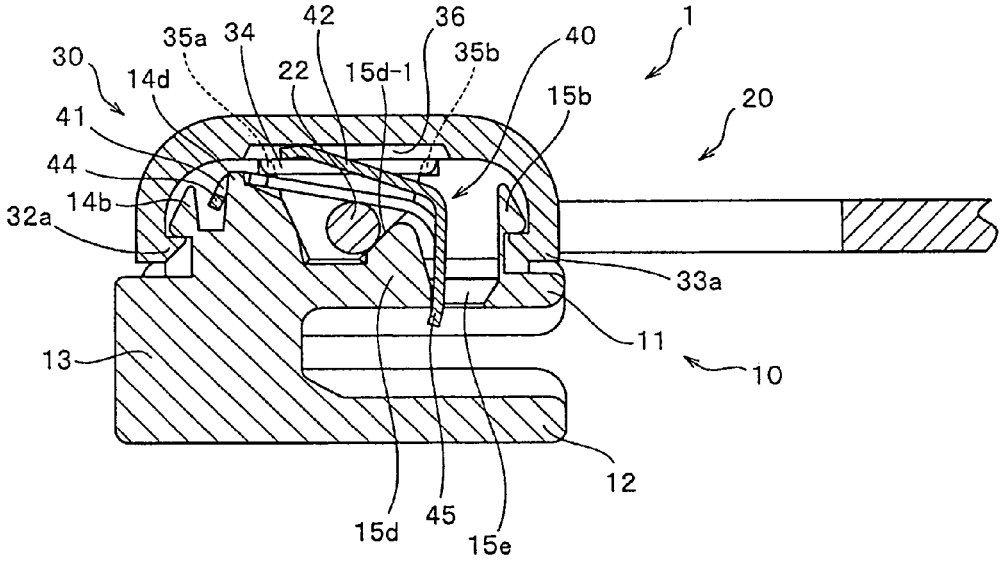
FIG. 4 is a main part longitudinal cross-sectional view showing an example of an internal structure after assembling the slider (the first embodiment).
Figure 5:
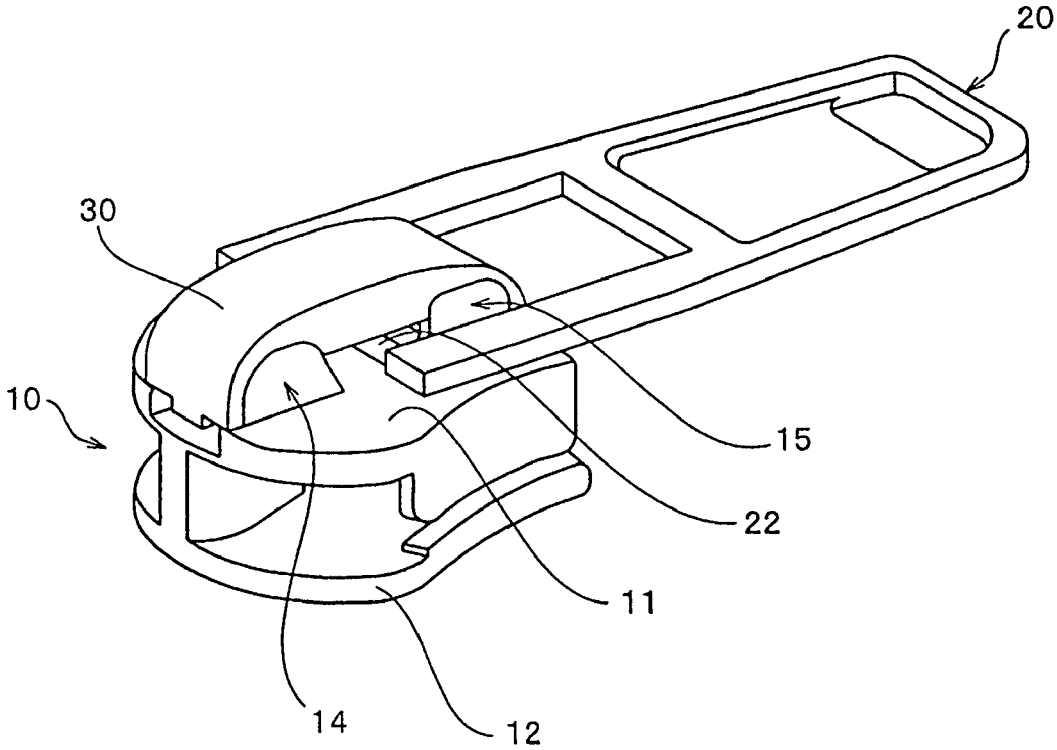
FIG. 5 is a perspective view showing the entire configuration of the slider (the first embodiment).

FIGS. 1 to 5 show a representative first embodiment of the present invention. FIG. 1 is a perspective view showing a state before components constituting a slider for a slide fastener with an automatic stopper are assembled. FIG. 2 is a perspective view of a pull-tab retainer constituting a part of the slider when viewed from the side of a back surface. FIG. 3 is a main part longitudinal cross-sectional view showing an assembly sequence of the slider. FIG. 4 is a main part longitudinal cross-sectional view showing an example of an internal structure after assembling the slider. FIG. 5 is a perspective view showing the entire configuration of the slider.

In this embodiment, a shoulder side of the slider is called a front part and a rear side of the slider is called a rear end.

First Embodiment

A slider 1 for a slide fastener with an automatic stopper shown in FIG. 1 is configured by four members including a slider body 10, a pull tab 20, a pull-tab retainer 30, and a spring body 40.

The three members including the slider body 10, the pull tab 20, and the pull-tab retainer 30 each are manufactured by injection molding, using a thermoplastic resin, such as polyamide, polypropylene, polyacetal, and polybutylene terephthalate, or a thermoplastic resin material added with an abrasion resistant reinforcement material. The spring body 40 is manufactured by press working, using a long minute elastic metal plate member, such as a copper alloy or stainless steel.

Instead of manufacturing the slider body 10 and the pull tab 20 using the thermoplastic resin material, the slider body 10 and the pull tab 20 can be manufactured by die-cast molding, using a metallic material, such as an aluminum alloy or a zinc alloy. The pull-tab retainer 30 can be manufactured by press working, using a long minute elastic metal plate member, such as a copper alloy or stainless steel, instead of manufacturing the pull-tab retainer 30 using the thermoplastic resin material.

The slider body 10 has an upper winglike piece 11, a lower winglike piece 12, and a connecting post 13 that connects front ends of the upper and lower winglike pieces 11 and 12. The upper and lower winglike pieces 11 and 12 are configured to have an upper flange 11*a* and a lower flange 12*a* that are formed at the left and right side edges, respectively over a way from rear ends of the upper and lower winglike pieces 11 and 12 to the approximately central positions. A Y-shaped engagement element guide passage using the connecting post 13 as a branching point is formed between the upper winglike piece 11 and lower winglike piece 12.

In anterior and posterior parts of a top surface of the upper winglike piece 11 of the slider body 10, an anterior mounting post 14 and a posterior mounting post 15 are erect. The anterior mounting post 14 and the posterior mounting post 15 are members that mount the pull-tab retainer 30 configured as a cover body having an elongated plate shape, and are formed integrally with the top surface of the upper winglike piece 11. A required interval is formed between the anterior mounting post 14 and the posterior mounting post 15, and the required interval is configured as a space sufficient to store a part of the pull tab 20, the spring body 40 and the pull-tab retainer 30.

In the posterior mounting post 15 that is erect at the rear side (right side of FIGS. 1, 3, and 4) of the slider, a pair of left and right posterior support walls 15*a* and 15*a* are provided. The horizontal width of external surfaces of the pair of posterior support walls 15*a* and 15*a* is configured to be almost equal to the horizontal width of an external shape of the pull-tab retainer 30. In each of superior angular corner regions of the front end sides of internal faces 17 of the pair of posterior support walls 15*a* and 15*a*, notches 15*c* to interlock first interlock parts 35*b* provided in the pull-tab retainer 30 to be described below are formed. The notches 15*c* are configured as stepped parts where upper portions and side portions are open and are configured as first interlocked parts in a regulating mechanism to regulate the displacement of the pull-tab retainer 30.

As shown in FIGS. 1, 3, and 4, in parts of the internal faces 17 of the pair of posterior support walls 15*a* and 15*a* that descend to be closer to the inner side than the outer edge, an engaged part 15*b* to engage the pull-tab retainer 30 is formed. A peripheral part of the outer edge of the internal face 17 is configured as a second interlocked part 17*a* in the regulating mechanism that regulates the displacement of the pull-tab retainer 30. Between the opposing peripheral parts of the outer edge in the second interlocked part 17*a*, a second interlock part 37*b* that is formed in the pull-tab retainer 30 to be described below can be fitted.

When the second interlock part 37*b* is fitted between the second interlocked parts 17*a*, a side end face 15*f* of the posterior support wall 15*a* comes into contact with the back surface of the pull-tab retainer 30 and acts as a contact surface to regulate the fitting position of the pull-tab retainer 30.

As shown in FIGS. 3 and 4, the engaged part 15*b* is configured as a member that interlocks an engagement piece 33*a* formed in the pull-tab retainer 30 to be described below, and is configured in a stepped part shape that has a guide inclination surface that is smoothly inclined downward and an engagement surface that is engaged with or is disengaged from the engagement piece 33*a* of the pull-tab retainer 30. As shown in FIG. 1, the engaged part 15*b* is formed integrally with the posterior support wall 15*a*, and is linearly disposed in a manner of connecting the internal faces 17 of the rear part side in the posterior support wall 15*a*.

As shown in FIGS. 1, 3, and 4, the pull-tab guide part 15*d* is formed integrally with the posterior support wall 15*a* between the opposing internal faces 17 of the front part side of the posterior support wall 15*a*, and the pull-tab guide part 15*d* is formed in a part lower than the engaged part 15*b*.

A tapered surface is formed on a front end face of the pull-tab guide part 15*d*. This tapered surface is configured as a pull-tab guide surface 15*d*-1 that is downward inclined toward the top surface of the upper winglike piece 11 at the front end face side of the posterior support wall 15*a*. When the pull tab 20 is operated, a pivot 22 of the pull tab 20 can be guided by the tapered surface of the pull-tab guide surface 15*d*-1. The pivot 22 of the pull tab 20 is guided along the pull-tab guide surface 15*d*-1, toward the moving limit position of the spring body 40 from a front part base end of the pull-tab guide part 15*d*.

In a part of the upper winglike piece 11 between a base end of the front part side in the engaged part 15*b* and a base end of the rear part side in the pull-tab guide part 15*d*, a rectangular claw hole part 15*e* where a claw part 45 of the spring body 40 is inserted and is separated is punched. That is, the claw hole part 15*e* is configured to penetrate the part of the upper winglike piece 11 between the base end of the front part side in the engaged part 15*b* and the base end of the rear part side in the pull-tab guide part 15*d* in an anteroposterior direction and communicate with the engagement element guide passage.

In the anterior mounting post 14 that is erect at the shoulder side (left side of FIGS. 1, 3, and 4) of the slider, a pair of left and right anterior support walls 14*a* and 14*a* are provided. The horizontal width of external surfaces of the pair of anterior support walls 14*a* and 14*a* is configured to be almost equal to the horizontal width of an external shape of the pull-tab retainer 30. In each of front end angular corner regions of the internal faces 17 of the pair of posterior support walls 15*a* and 15*a*, notches 15*c* to interlock the first interlock parts 35*b* provided in the pull-tab retainer 30 to be described below are formed. The notches 15*c* are configured as stepped parts where upper portions and side portions are open and are configured as first interlocked parts in the regulating mechanism to regulate the displacement of the pull-tab retainer 30.

In parts of the internal faces 16 of the pair of anterior support walls 14*a* and 14*a* that descend to be closer to the inner side than the outer edge, engaged parts 14*b* that engage the pull-tab retainer 30 and a protrusion 14*d* that hooks an opening window 41 of the spring body 40 to be described below are formed. A peripheral part of the outer edge of the internal face 16 is configured as a second interlocked part 16*a* in the regulating mechanism that regulates the displacement of the pull-tab retainer 30. Between the opposing peripheral part of the outer edge in the second interlocked part 16*a*, a second interlock part 37*a* that is formed in the pull-tab retainer 30 to be described below can be fitted.

When the second interlock part 37*a* is fitted between the second interlocked parts 16*a*, a side end face 14*f* of the anterior support wall 14*a* comes into contact with the back surface of the pull-tab retainer 30 and acts as a contact surface to regulate the fitting position of the pull-tab retainer 30.

As described above, the horizontal width of the external shape of the pull-tab retainer 30 is configured to be almost equal to the horizontal width of the external surfaces in the pair of anterior support walls 14*a* and 14*a*, and the horizontal width of the external surfaces in the pair of posterior support walls 15*a* and 15*a*. Accordingly, if the pull-tab retainer 30 is mounted in the anterior mounting post 14 and the posterior mounting post 15, the side end face 14*f* of the anterior support wall 14*a* and the side end face 15*f* of the posterior support wall 15*a* can be covered and shielded by the back surface side of the pull-tab retainer 30. The side end face of the pull-tab retainer 30 and the external surface of the anterior support wall 14*a* can be configured to be almost flush with each other.

As shown in FIGS. 3 and 4, the engaged part 14*b* is configured as a member that interlocks the engagement piece 32*a* formed in the pull-tab retainer 30 to be described below, and is configured in a stepped part shape that has a guide inclination surface that is smoothly inclined downward and an engagement surface that is engaged with or disengaged from the engagement piece 33*a* of the pull-tab retainer 30. The engaged part 14*b* is formed integrally with the anterior support wall 14*a*, and is linearly disposed in a form of connecting the internal faces 16 of the front part side in the anterior support wall 14*a*.

The protrusion 14*d* is configured as a member that hooks an opening window 41 of the spring body 40 to be described below, and is formed integrally with the anterior support wall 14*a*. As shown in FIGS. 3 and 4, a part between the member constituting the protrusion 14*d* and the interlocked part 14*b* is configured as a downward recessed groove 14*e*, and is configured as a space to hook a hooking part 44 of the spring body 40 to be described below.

As shown in FIG. 1, the pull tab 20 is configured by a strip-shaped plate member. The pull tab 20 has a handle part 21 at one end side thereof and a circular holding part 23 having an approximately square hole part 23*a*, in which the posterior mounting post 15 can be fitted, at the other end side thereof. A fore-end of the circular holding part 23 is provided with the pivot 22 having a circular section, and the pivot 22 configures a part of the circular holding part 23 in a bridge shape.

The length of the pivot 22 is set to be larger than the width dimension of the posterior mounting post 15. When the pull tab 20 is mounted, the pivot 22 that crosses the posterior mounting post 15 is moved so as to be guided along the pull-tab guide part 15*d*, so that the posterior mounting post 15 is inserted into the hole part 23*a*.

As shown in FIGS. 1 and 2, the pull-tab retainer 30 is configured by a long thin plate member. In anterior and posterior portions of a flat upper wall part 31, anterior and posterior wall parts 32 and 33 that are continuous from the upper wall part 31 are formed. The pull-tab retainer 30 is configured as a cover body with a substantially lateral C shape in side view.

On the internal faces of each of the fore-ends in the anterior and posterior wall parts 32 and 33, engagement pieces 32*a* and 33*a* protrude. The engagement pieces 32*a* and 33*a* are elastically engaged with and disengaged from an engagement surface of the engaged part 14*b* formed in the anterior mounting post 14 and an engagement surface of the engaged part 15*b* formed in the posterior mounting post 15.

On the right and left sides of the upper wall part 31 of the pull-tab retainer 30, wide side-to-side winglike pieces 34 that cover and shield a part of the space between the anterior mounting post 14 and the posterior mounting post 15 are formed in a downward protruding shape. The surface of the side-to-side winglike piece 34 at the lower end side and the external sides of the anterior support wall 14*a* and the posterior support wall 15*a* are configured to be substantially flush with each other.

The first interlock parts 35*a* and 35*b* that are interlocked by the notches 14*c* and 15*c* formed in the anterior support wall 14*a* and the posterior support wall 15*a* are formed in both edge portions of the side-to-side winglike pieces 34. The thickness of the first interlock parts 35*a* and 35*b* is configured to be thinner than the thickness of the side-to-side winglike pieces 34, and the first interlock parts 35*a* and 35*b* are configured to be disposed at the internal face sides of the side-to-side winglike pieces 34.

If the first interlock parts 35*a* and 35*b* are formed in both edge portions of the side-to-side winglike pieces 34, the first interlock parts 35*a* and 35*b* can be supported in two surfaces of the edge parts of the side-to-side winglike pieces 34 and the back surface of the pull-tab retainer 30. Therefore, mounting strength of the first interlock parts 35*a* and 35*b* can be improved.

As shown in FIG. 2, the first interlock parts 35*a* and 35*b* may be formed in only the front part side or the rear part side of the side-to-side winglike pieces 34 or only the crossing corner regions, instead of forming the first interlock parts 35*a* and 35*b* in the four corner regions of the side-to-side winglike piece 34. The notches 14*c* and 15*c* can be formed in only the anterior support wall 14*a* or the posterior support wall 15*a*, or only the crossing corner regions of the anterior support wall 14*a* and the posterior support wall 15*a*, to correspond to the formation parts of the first interlock parts 35*a* and 35*b*.

That is, the number of first interlock parts 35*a* and 35*b* and notches 14*c* and 15*c* disposed can be configured as a combination of even numbers, and combinations of the first interlock part 35*a* or the first interlock part 35*b* and the notch 14*c* or the notch 15*c* are desirably configured to be equally disposed in a side-to-side direction of the slider 1. That is, when the external force of the side-to-side direction is applied to the pull-tab retainer 30, it is desirable that the first interlock parts 35*a* and 35*b* and the notches 14*c* and 15*c* are disposed such that the external force can be received by the first interlock parts 35*a* and 35*b* and the notches 14*c* and 15*c* with an excellent balance.

As shown in FIG. 2, in a central part of the back surface side of the pull-tab retainer 30, a storage recess part 36 that inserts the spring piece 42 of the spring body 40 is formed. Second interlock parts 37*a* and 37*b* protrude at the back surface side of the pull-tab retainer 30 with the storage recess part 36 in the longitudinal direction therebetween. The second interlock parts 37*a* and 37*b* are fitted between the second interlocked parts 16*a* of the anterior support wall 14*a* and between the second interlocked parts 17*a* of the posterior support wall 15*a*, when the pull-tab retainer 30 is mounted in the anterior mounting post 14 and the posterior mounting post 15.

Accordingly, the first interlock parts 35*a* and 35*b* and the second interlock parts 37*a* and 37*b* are disposed between the anterior and posterior support walls 14*a* and 15*a* of the anterior and posterior mounting posts 14 and 15, between the side end faces of both sides of the side-to-side winglike pieces 34 and the anterior and posterior wall parts 32 and 33 of the pull-tab retainer 30. By the first interlock parts 35*a* and 35*b*, the notches 14*c* and 15*c* where the first interlock parts 35*a* and 35*b* are interlocked, the second interlock parts 37*a* and 37*b*, and the second interlocked parts 16*a* and 17*a* where the second interlock parts 37*a* and 37*b* are interlocked and fitted, the regulating mechanism that regulates the displacement of the pull-tab retainer 30 is configured.

Figure 6:
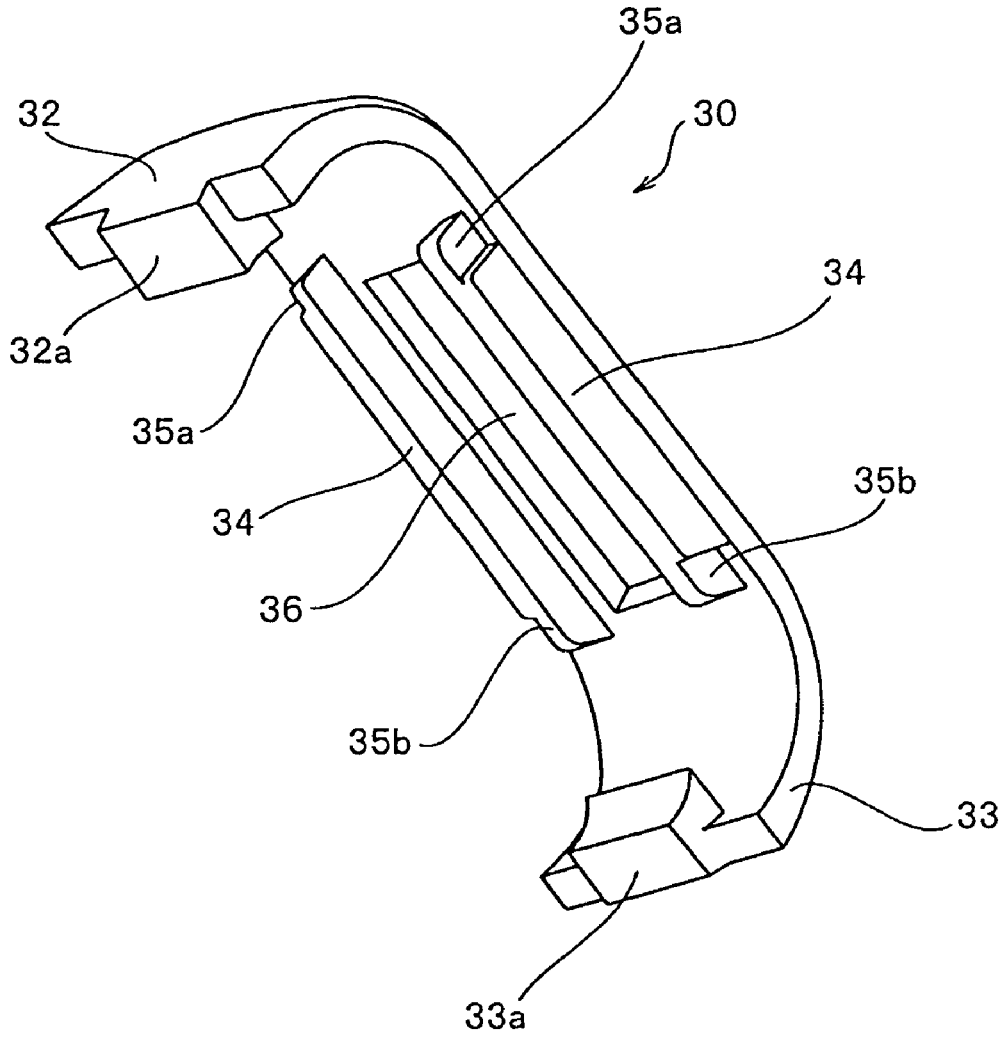
FIG. 6 is a perspective view of a pull-tab retainer having another configuration when viewed from the side of a back surface (the first embodiment).

Regarding the protrusion amounts from the back surface of the upper wall part 31 of the pull-tab retainer 30 in the first interlock parts 35*a* and 35*b* and the second interlock parts 37*a* and 37*b*, the protrusion amounts of the first interlock parts 35*a* and 35*b* can be configured to be larger than the protrusion amounts of the second interlock parts 37*a* and 37*b*. By this configuration, the protrusion amounts of the second interlock parts 37*a* and 37*b* can be decreased. Alternatively, as shown in FIG. 6, the second interlock parts 37*a* and 37*b* may not be formed on the back surface of the upper wall part 31.

Even in these cases, since the first interlock parts 35*a* and 35*b* can be interlocked with the notches 14*c* and 15*c* formed on the anterior and posterior support walls 14*a* and 15*a*, the pull-tab retainer 30 can be surely prevented from being displaced in the anteroposterior side-to-side directions, even though the external force is applied in the anteroposterior side-to-side directions with respect to the pull-tab retainer 30.

By decreasing the protrusion amounts of the second interlock parts 37*a* and 37*b* or by the configuration in which the second interlock parts 37*a* and 37*b* are not formed on the back surface of the upper wall part 31, flexibility and elastic force in the pull-tab retainer 30 can be enhanced. That is, when the pull-tab retainer 30 is engaged with the anterior and posterior mounting posts 14 and 15, a gap between both edge portions of the pull-tab retainer 30 can be easily expanded while the pull-tab retainer 30 is elastically deformed. Since the flexibility of the pull-tab retainer 30 can be enhanced, the pull-tab retainer 30 can be prevented from being damaged during the elastic deformation in which the gap between both edge portions of the pull-tab retainer 30 expands.

The spring body 40 is configured to have a body made of a plate member such as a copper alloy or stainless steel, and a rectangular opening window 41 formed on one end of the body in a longitudinal direction. The spring body 40 is provided with a spring piece 42, and the spring piece 42 is configured such that a central part of the spring body 40 in a longitudinal direction is blanked from the body-side end of the opening window 41 by a cutout hole part 43, and a blanking part is pulled and erect.

The fore-end of the spring piece 42 on which the bending working is performed is raised from a base end of the spring piece 42 toward the front, to a predetermined height to be suspended in the air, so that the spring piece 42 forms a V shape. The bending working is performed on the side of the fore-end of the spring piece 42, and the fore-end of the spring piece 42 is configured to have a flat shape.

As shown in FIG. 1, both sides of the spring piece 42 at the side of the fore-end are formed as a tapered surface 42*a* that gradually decreases toward the fore-end of the shoulder direction of the slider. The fore-end of the flat spring piece 42 is stored in the storage recess part 36 that is formed in the back surface of the pull-tab retainer 30, thereby preventing the spring piece 42 from being displaced in the side-to-side direction.

In both edge portions of the spring body 40 in the anteroposterior direction, a short plate piece and a long plate piece that are bent toward the lower side of the side of a surface opposite to the spring piece 42 are formed to be substantially parallel. In the short plate piece, a hooking part 44 that is hooked into the recessed groove 14*e* of the anterior mounting post 14 is configured. In the fore-end of the long plate piece, a claw part 45 is configured.

The fore-end of the claw part 45 is formed to have the width smaller than the width of the body of the spring body 40. The shape of the fore-end of the claw part 45 is configured to have a required form with a required size, such that the claw part 45 passes the claw hole part 15*e* formed in the posterior mounting post 15 and can be inserted into the engagement element guide passage in the slider body 10.

In the opening window 41 that is punched in a bending part of the short plate piece, a protruding piece 14*d* that is formed in the anterior mounting post 14 can be inserted. The entire configuration of the spring body 40 that is configured in the above way is configured in a substantially lateral C shape in side view, except for the spring piece 42.

Since the spring piece 42 can be formed by blanking working, the spring body 40 can be manufactured from the plate member having a requisite minimum dimension. For this reason, the use amount of the plate member that is used to manufacture the spring body 40 can be saved. Since the configuration of the spring body 40 is simple as described above, a yield in the manufacturing of the spring body 40 can be improved.

The fore-end of the spring piece 42 is configured to come into sliding contact with and come into elastic contact with the storage recess part 36 formed in the back surface of the pull-tab retainer 30. Therefore, the dimension of the storage recess part 36 in a longitudinal direction is configured to become the dimension allowing sliding contact of the fore-end of the spring piece 42.

A gap of a planar direction is formed between the fore-end of the spring piece 42 and the rising-side ridge line part of the spring piece 42 after the spring piece 42 is pulled and erect. If the gap of the planar direction is formed, even though the spring piece 42 is fitted to the cutout hole part 43 when the spring piece 42 is elastically deformed, the cutout hole part 43 and the spring piece 42 are not hooked, and the state of the spring piece 42 can be smoothly and surely elastically returned to the original state. Accordingly, the automatic stop function of the slider 1 can be maintained a stable state over a long period.

The manufacturing of the spring body 40 that is configured in the above way will be described. First, the part that is adjacent to the front end face of the spring piece 42 is previously blanked from the plate member constituting the spring body 40, and a blanking hole part that becomes the opening window 41 is formed. The part of the formation part that becomes the claw part 45 is blanked and cut out from the plate member.

Next, the fore-end of the spring piece 42 is configured to become the opening window 41, and the left and right side end edges along the outline form that is gradually reduced toward the fore-end of the spring piece 42 are blanked and worked by a blanking punch. After the blanking working, the bending working is performed on the spring piece 42, the fore-end of the spring piece 42 is pulled and raised to the predetermined height to form a substantially V shape. The spring body 40 that has the opening window 41 is finished to form the approximately lateral C shape as a whole.

Since the spring body 40 configured in the above way can be provided with the opening window 41, the spring piece 42 can be easily pulled and raised through the opening window 41. The required blanking height of the spring piece 42 with respect to the plate member can be obtained, and the spring piece 42 can be prevented from being damaged or cracking that is attributable to the excessive force applied to the fore-end of the spring piece 42 during the working. The spring body 40 that has desired spring stiffness can be easily and surely manufactured.

As such, since the spring body 40 can be simply manufactured, the spring body 40 can be manufactured using the existing working device, without needing various special ancillary facilities or peripheral devices. Accordingly, productivity can be improved, a processing cost can be reduced, and a manufacturing time of the spring body 40 can be reduced. Therefore, a manufacturing cost can be greatly reduced.

Although the example of the configuration where the entire spring piece 42 is suspended in a substantially V shape toward the front is described as a configuration of the spring piece 42, the present invention is not limited thereto. For example, the bending working is performed on the spring piece 42, and the fore-end of the spring piece 42 is pulled and raised to the predetermined height by the configuration where the spring piece 42 is bent downward one or more times.

Next, an assembly sequence of the slider 1 when the slider 1 is assembled so to have a configuration shown in FIG. 5 will be described.

When the slider 1 is assembled, as shown in FIG. 3, first, the hole part 23*a* of the circular holding part 23 (refer to FIG. 1) of the pull tab 20 passes through the posterior mounting post 15 of the slider body 10 so as to be inserted. The pivot 22 of the pull tab 20 is loaded on the slider body 10 such that the entire pull tab 20 comes to have a substantially horizontal posture, in a state where the pivot 22 comes into contact with the pull-tab guide surface 15*d*-1 of the pull-tab guide part 15*d* of the posterior support wall 15*a* (refer to FIG. 1).

Next, the spring body 40 is disposed at the upper side of the pivot 22 of the pull tab 20. At this time, the claw part 45 of the spring body 40 is inserted into the claw hole part 15*e* of the posterior mounting post 15, and the opening window 41 is hooked into the protruding piece 14*d* of the anterior mounting post 14 that exists at the position higher than the position of the claw hole part 15*e*. At the same time, the hooking part 44 is inserted into the recessed groove 14*e* of the anterior mounting post 14.

At this time, the spring body 40 is disposed in a state where the spring body 40 is inclined upward from the claw hole part 15*e* to the side of the protruding piece 14*d* in the top surface of the upper winglike piece 11. Next, the pull-tab retainer 30 is mounted in the anterior and posterior mounting posts 14 and 15 from the upper side of the spring body 40, while being against the elastic force of the spring piece 42.

When the pull-tab retainer 30 is mounted in the anterior and posterior mounting posts 14 and 15, the engagement pieces 32*a* and 33*a* of the pull-tab retainer 30 slide while being elastically deformed in an expansion direction along the guide inclination surfaces of the engaged parts 14*b* and 15*b* of the anterior and posterior mounting posts 14 and 15. At the same time as when the engagement pieces 32*a* and 33*a* pass through the fore-end inclination surface of the guide inclination surface, the engagement pieces 32*a* and 33*a* are elastically returned in a reduction direction and are engaged with the engagement surfaces of the engaged parts 14*b* and 15*b*.

At the same time, the first interlock parts 35*a* and 35*b* are interlocked with the notches 14*c* and 15*c* and the second interlock parts 37*a* and 37*b* are fitted between the second interlocked parts 16*a* and 17*a*. The lower end face of the side-to-side winglike piece 34 of the pull-tab retainer 30 is disposed at the position away from the top surface of the upper winglike piece 11, and a part of the pull tab 20 and a part of an operation space in which the spring body 40 is operated are shielded by the side-to-side winglike piece 34. In this way, assembling of the slider 1 is finished.

According to the present invention, the simple configuration where the engagement pieces 32*a* and 33*a* of the pull-tab retainer 30 and the engaged parts 14*b* and 15*b* of the anterior and posterior mounting posts 14 and 15 are engaged and fixed is used, and the spring body 40 can be stored between the pull-tab retainer 30 and the slider body 10 in a release disabled state by only mounting the pull-tab retainer 30 in the slider body 10.

The assembly work of the slider 1 can be easily and surely performed in a stable state, using a hand or an automatic assembling machine. The regulating mechanism can prevent the pull-tab retainer 30 from being loosened in the anteroposterior side-to-side directions. The spring piece 42 can be smoothly and surely elastically deformed in the space formed between the back surface of the pull-tab retainer 30 and the opposing faces of the anterior and posterior mounting posts 14 and 15. Since the damage, the defective deformation, and the failure of the spring piece 42 can be prevented, durability of the spring body 40 can be ensured over a long period.

The releasing operation of the engagement state of the claw part 45 of the spring body 40 and the engagement element (not shown in the drawings) from the state of FIG. 4 will be described. First, as shown in FIG. 4, if the pull tab 20 that is assembled to be in parallel with the slider body 10 is lifted upward by the hand or the pull tab 20 is pulled backward, the pivot 22 of the pull tab 20 rises along the pull-tab guide surface 15*d*-1 of the pull-tab guide part 15*d*.

If the pivot 22 of the pull tab 20 rises, the spring body 40 is also lifted upward and the spring piece 42 is bent in a direction where the elastic force is accumulated. The claw part 45 of the spring body 40 rocks toward the front on the basis of the pivot 22 of the pull-tab 20, while being elastically deformed in a direction where the engagement state with the engagement element (not shown in the drawings) is released.

If the pivot 22 of the pull tab 20 comes into contact with the lower end face of the side-to-side winglike piece 34 and moves to the movement limit position of the spring body 40, the claw part 45 is separated from the engagement element that has been engaged so far, and the engagement state of the claw part 45 with the engagement element is released.

When the engagement state of the claw part 45 and the engagement element is released, the slider 1 can freely slid to the shoulder side (left side of FIG. 4) or the rear side (right side of FIG. 4) of the slider. If the slider 1 freely slides, the tooth rows of the fastener chain (not shown in the drawings) can be coupled to or released from each other in a side-to-side direction. After the desired operation, if the hand releases the pull tab 20, the spring piece 42 of the spring body 40 is elastically returned.

The pivot 22 of the pull tab 20 descends along the pull tab guide surface 15*d*-1 by the biasing force according to the elastic return of the spring piece 42. The claw part 45 of the spring body 40 is also inserted into the claw hole part 15*e* by the biasing force of the spring piece 42, and is automatically inserted between the teeth of the fastener chain existing in the lower part of the claw hole part 15*e*. As such, the claw part 45 of the spring body 40 are engaged with the engagement element by the biasing force of the spring piece 42.

If the engagement state between the claw part 45 and the engagement element is maintained by the biasing force from the spring body 40, the sliding of the slider 1 is prohibited, and the stop state of the slider 1 can be maintained.

In the slider 1 of the present invention, the regulating mechanism that is configured by the first interlock parts 35*a* and 35*b*, the notches 14*c* and 15*c*, and the regulating mechanism that is configured by the second interlock parts 37*a* and 37*b*, and the second interlocked parts 16*a* and 17*a* are adopted to prevent the pull-tab retainer 30 from being loosened in the anteroposterior side-to-side directions.

As the regulating mechanism, only one of the regulating configurations based on the first interlock parts 35*a* and 35*b* and the notches 14*c* and 15*c* or the regulating configuration based on the second interlock parts 37*a* and 37*b* and the second interlocked parts 16*a* and 17*a* can be used.

By adopting the regulating mechanism, the side end face 14*f* of the anterior support wall 14*a* of the anterior mounting post 14 and the side end face 15*f* of the posterior support wall 15*a* of the posterior mounting post 15 can be covered up by the pull-tab retainer 30 mounted in the anterior mounting post 14 and the posterior mounting post 15.

At this time, since the side end face of the pull-tab retainer 30, the external side of the side-to-side winglike piece 34, and the external surfaces of the anterior support wall 14*a* and the posterior support wall 15*a* are disposed to flush with each other, an exterior design in the slider 1 can be greatly improved.

As such, the pull-tab retainer 30 can be firmly and surely mounted in the anterior mounting post 14 and the posterior mounting post 15, in a state where the pull-tab retainer 30 does not swing against various forces applied in the anteroposterior side-to-side directions by the regulating mechanism. Accordingly, the pull-tab retainer 30 can be formed to have the requisite minimum thickness, and downsizing and thinning of the slider 1 can be achieved.

The side-to-side winglike piece 34 of the present invention is formed to have the length almost equal to the interval between the anterior mounting post 14 and the posterior mounting post 15. However, the length dimension of the side-to-side winglike piece 34 in an anteroposterior direction is configured to be shorter than the height dimension of the anterior wall part 32 and the posterior wall part 33 in the anteroposterior direction. By this configuration, when the slider body 10 and the pull-tab retainer 30 are in an engagement state, the position of the lower end face of the side-to-side winglike piece 34 can be positioned above apart from the top surface of the upper winglike piece 11.

The space in which the pivot 22 of the pull tab 20 can move can be formed between the lower end face of the side-to-side winglike piece 34 and the top surface of the upper winglike piece 11. The space that is surrounded by the back surface of the pull-tab retainer 30 and the top surface of the upper winglike piece 11 can be used as the operation space for the case in which the pivot 22 of the pull tab 20 and the spring body 40 are operated, when the slider body 10 and the pull-tab retainer 30 are in an engagement state.

Since the spring piece 42 of the spring body 40 can be smoothly and surely held between the pull-tab retainer 30 and the upper winglike piece 11, the quality of the slider 1 can be ensured in a stable state over a long period.

As such, in the present invention, the size and thickness of the slider 1 can be reduced, and the excellent exterior design can be obtained. Therefore, a slider that has a high commodity value can be obtained.

Second Embodiment

Figure 7:
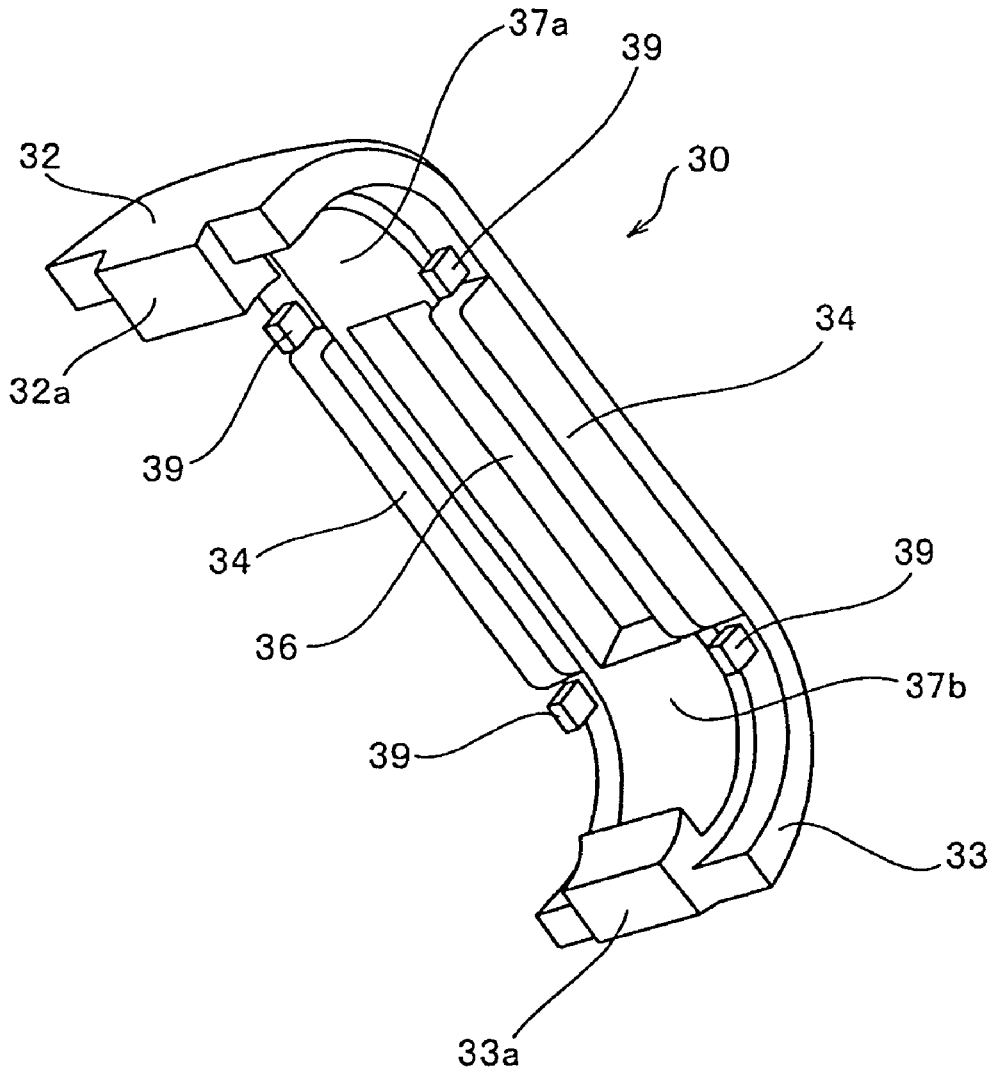
FIG. 7 is a perspective view of a pull-tab retainer constituting a part of a slider when viewed from the side of a back surface (a second embodiment).
Figure 8:
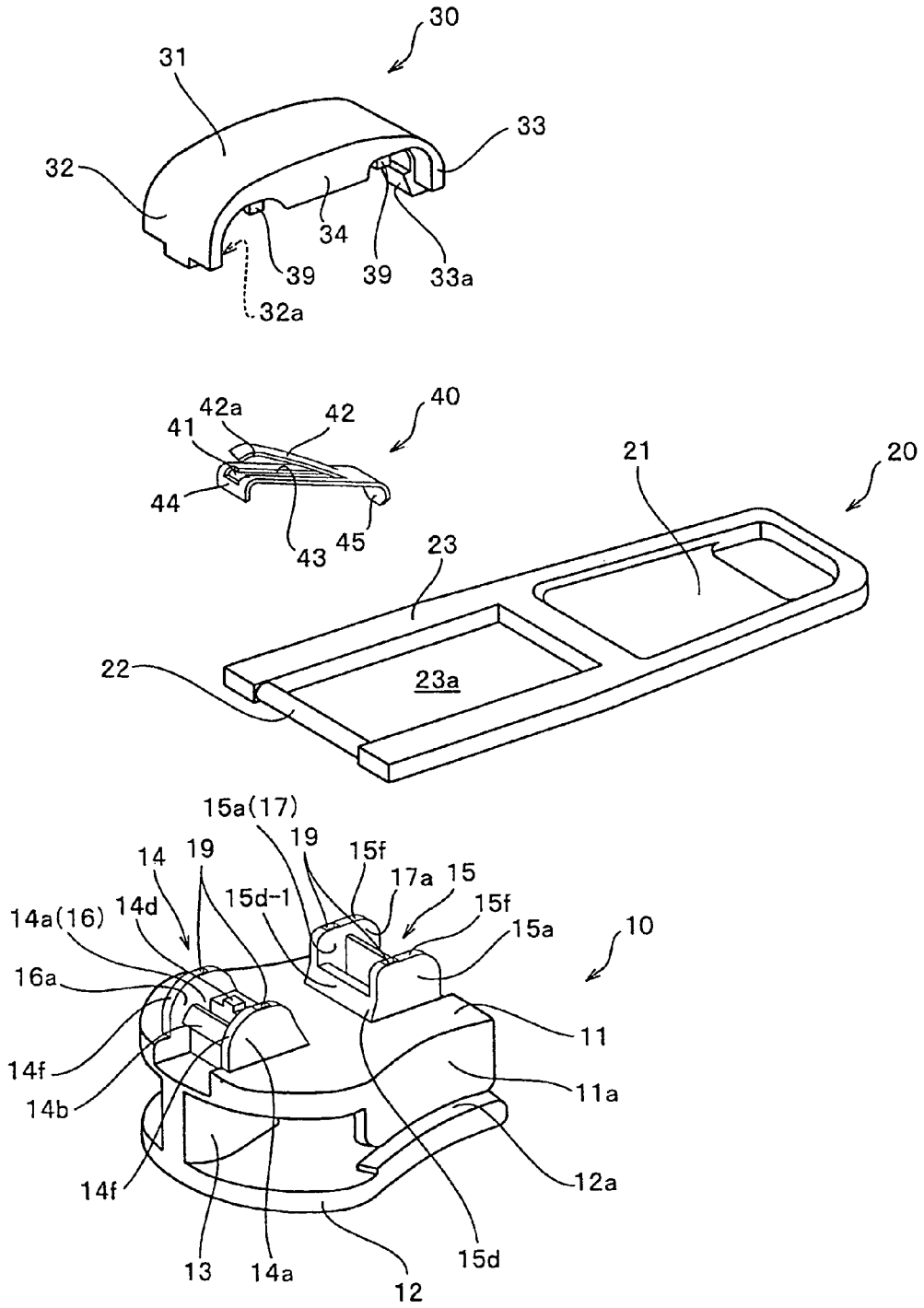
FIG. 8 is a perspective view showing a state before components constituting a slider for a slide fastener with an automatic stopper are assembled (the second embodiment).
Figure 9:
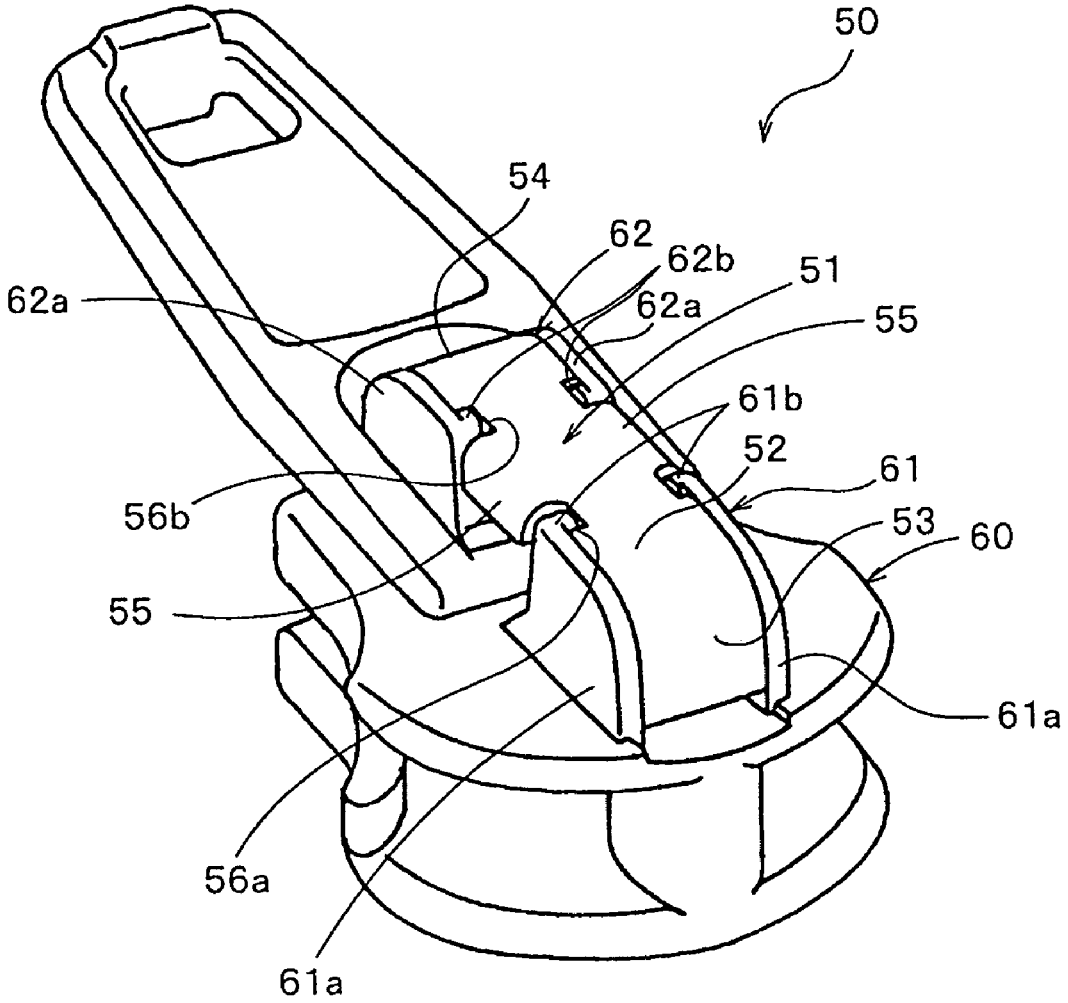
FIG. 9 PRIOR ART
FIG. 9 is a perspective view of a slider for a slide fastener with an automatic stopper (a conventional example).

FIGS. 7 and 8 show a modification of the regulating mechanism according to the present invention. FIG. 7 is a perspective view of a pull-tab retainer when viewed from the side of a back surface. FIG. 8 is a perspective view showing a state before components constituting a slider for a slide fastener with an automatic stopper using a pull-tab retainer according to a second embodiment are assembled.

As one of the regulating mechanisms in the first embodiment, the configuration where the first interlock parts 35*a* and 35*b* are formed in both edge portions of the side-to-side winglike piece 24 and the notches 14*c* and 15*c* to which the first interlock parts 35*a* and 35*b* are interlocked are formed in the corner regions of the anterior support wall 14*a* and the posterior support wall 15*a* is adopted. Meanwhile, in the second embodiment, the configuration where the first interlock parts 35*a* and 35*b* and the notches 14*c* and 15*c* are not provided, protrusion interlock pieces 39 are provided in parts away from both edge portions of the side-to-side winglike piece 24 and interlocked hole parts 19 are punched in the side end face 14*f* of the anterior support wall 14*a* and the side end face 15*f* of the posterior support wall 15*a* is adopted.

The protrusion interlock piece 39 is inserted into the interlocked hole part 19 and one regulating mechanism is configured. The other regulating mechanism of the regulating mechanisms in the first embodiment which is configured by the second interlock parts 37*a* and 37*b*, the internal face 16 of the anterior support wall 14*a*, and the internal face 17 of the posterior support wall 15*a* is used in the second embodiment without alternation of the configuration of the first embodiment.

Another configuration of the second embodiment is the same as that of the first embodiment. Accordingly, the same components as those of the first embodiment will be denoted by the same reference numerals as those used in the first embodiment, and the description thereof will not be repeated.

As shown in FIG. 7, in parts that are apart from both edge portions of the side-to-side winglike piece 24 at the side of the back surface of the pull-tab retainer 30, protrusion interlock pieces 39 that are erect from the back surface of the pull-tab retainer 30 and are independent from the side-to-side winglike piece 34 are formed, respectively. As shown in FIG. 8, in the side end faces 14*f* of the pair of anterior support walls 14*a* in the anterior mounting post 14 and the side end faces 15*f* of the pair of posterior support walls 15*a* in the posterior mounting post 15, interlocked hole parts 19 where each protrusion interlock piece 39 of the pull-tab retainer 30 is inserted and interlocked when the pull-tab retainer 30 is mounted in the anterior mounting post 14 and the posterior mounting post 15 are formed.

The number of protrusion interlock pieces 39 and interlocked hole parts 19 disposed can be set as an even number, and the protrusion interlock pieces 39 and the interlocked hole parts 19 are desirably configured to be equally disposed in a side-to-side direction of the slider 1. That is, when the external force of the side-to-side direction is applied to the pull-tab retainer 30, the protrusion interlock pieces 39 and the interlocked hole parts 19 are desirably disposed such that the external force can be received by the protrusion interlock pieces 39 and the interlocked hole parts 19 with an excellent balance.

As the configuration of the interlocked hole part 19, in addition to the configuration where the interlocked hole part 19 is formed in a hole shape in which the upper portion is open, the interlocked hole part 19 may be configured in a groove shape in which the interlocked hole part is open to the side of the internal face 16*f* of the anterior support wall 14*a* and the side of the internal face 17 of the posterior support wall 15*a*.

As one of the regulating mechanisms, by using the configuration of the protrusion interlock piece 39 and the interlocked hole part 19, in the protrusion interlock piece 39 that is inserted into each interlocked hole part 19, the pull-tab retainer 30 can be prevented from being displaced in the anteroposterior side-to-side directions, and the displacement of the pull-tab retainer 30 can be surely prevented. The displacement of the pull-tab retainer 30 in the anteroposterior side-to-side directions can be regulated by using only at least one protrusion interlock piece 39 inserted into the interlocked hole part 19. For this reason, the number of protrusion interlock pieces 39 disposed can be decreased.

The above-described embodiments exemplify the preferred embodiments of the present invention. However, the configuration of the regulating mechanism is not limited to the above configurations. For example, protrusions having a protrusion shape are formed along the side end face 14*f* of the anterior support wall 14*a* and the side end face 15*f* of the posterior support wall 15*a*, and grooves having a recessed shape where the protrusions are fitted may be formed in the back surface of the pull-tab retainer 30.

Even though the regulating mechanism is configured in the above way, the object of the present invention can be sufficiently achieved. Accordingly, the present invention is not limited to the above-described embodiments and various design changes can be made in a range described in claims.

INDUSTRIAL APPLICABILITY

The present invention can be preferably applied to a slider including the pull-tab retainer in addition to a slider with an automatic stopper.

The invention claimed is:

1. A slider for a slide fastener with an automatic stopper comprising:

a slider body that couples and releases tooth rows of a fastener chain;

a pull tab that is adapted to slide the slider body;

a pull-tab retainer that is mounted and supported on the slider body and movably holds the pull tab between a top surface of the slider body and the pull-tab retainer; and a spring body that is disposed between a back surface of the pull-tab retainer and the slider body;

the spring body having a spring piece that is disposed between the back surface of the pull-tab retainer and the pull tab to elastically contact the back surface of the pull-tab retainer, and a claw part that is engaged with or is disengaged from a part of the tooth rows of the fastener chain passing through the slider body, on the basis of elastic deformation of the spring piece based on an operation of the pull tab, in anterior and posterior portions of the top surface of the slider body, an anterior mounting post and a posterior mounting post are provided, respectively, wherein an engaged part is formed on each of the mounting posts, the pull-tab retainer is configured as a cover body with a substantially lateral C shape in side view that has anterior and posterior wall parts formed in anterior and posterior portions of a flat upper wall part, in internal faces of each fore-ends of the anterior and posterior wall parts, engagement pieces that are elastically engaged with the engaged parts are formed, wherein in a side-to-side direction of the slider, a width dimension of the pull-tab retainer and width dimensions of the anterior mounting post and the posterior mounting post are configured to be almost equal to each other, the pull-tab retainer has a side-to-side winglike piece that protrudes downward from both sides of the upper wall part of the pull-tab retainer and covers and shields a space between the anterior mounting post and the posterior mounting post, the anterior mounting post and the posterior mounting post have support walls that are erect on left and right end faces of the anterior mounting post and the posterior mounting post, respectively, regulating mechanisms that regulate movement of the upper wall part of the pull-tab retainer in the side-to-side direction are provided between the pull-tab retainer and at least one of the anterior mounting post and the posterior mounting post, the regulating mechanisms include interlock parts that are configured in a shape protruding downward from a back surface of the upper wall part, between a side end face of the side-to-side winglike piece and the anterior and posterior wall parts, at the side of the internal face of the side-to-side winglike piece in the side-to-side direction of the slider, and interlocked parts that are formed in a shape storing the interlock parts, at the side of internal faces of the support walls in the side-to-side direction of the slider, and when the engagement pieces of the pull-tab retainer are engaged with an engaged part of the anterior mounting post and an engaged part of the posterior mounting post, respectively, the interlock parts and the interlocked parts are interlocked with each other, and the pull-tab retainer is disposed to cover up side end faces of the anterior mounting post and the posterior mounting post.

2. The slider for a slide fastener with an automatic stopper of claim 1, wherein the interlock parts are configured in a shape extending toward the anterior and posterior wall parts from the side-to-side winglike piece, and the interlocked part is configured as a stepped part where the upper portion and the side portions are open, in superior angular corner regions where the anterior support wall and the posterior support wall stand face to face with each other in the internal faces of the support walls.

3. The slider for a slide fastener with an automatic stopper of claim 1, wherein the interlock parts have first interlock parts that are configured in a shape extending toward the anterior and posterior wall parts from the side-to-side winglike piece and second interlock parts that are fitted between the internal faces of the support walls, when the engagement pieces of the pull-tab retainer are engaged with the engaged part of the anterior mounting post and the engaged part of the posterior mounting post, respectively, and the interlocked parts interlock the first interlock parts, and have stepped parts where the upper portion and the side portions are open, in superior angular corner regions where the anterior support wall and the posterior support wall stand face to face with each other in the internal faces of the support walls and parts of an outer edge side in the internal faces of the support walls.

4. The slider for a slide fastener with an automatic stopper of claim 3, wherein, in the protrusion amount from the back surface of the upper wall part, the protrusion amounts in the first interlock parts are larger than the protrusion amounts in the second interlock parts.

* * * * *